US008353589B2

(12) United States Patent
Ikeda et al.

(10) Patent No.: US 8,353,589 B2
(45) **Date of Patent: *Jan. 15, 2013**

(54) IMAGE FORMING METHOD

(75) Inventors: Masashi Ikeda, Tokyo (JP); Hirotaka Iljima, Tokyo (JP); Hisashi Mori, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 374 days.

This patent is subject to a terminal disclaimer.

(21) Appl. No.: 12/724,853

(22) Filed: Mar. 16, 2010

(65) Prior Publication Data

US 2010/0245508 A1 Sep. 30, 2010

(30) Foreign Application Priority Data

Mar. 25, 2009 (JP) ..... 2009-073510

(51) Int. Cl.
*B41J 2/01* (2006.01)

(52) U.S. Cl. ..... 347/102; 347/101; 347/100; 347/96

(58) Field of Classification Search ..... 347/100, 347/95, 96, 101, 102, 105; 106/31.6, 31.27, 106/31.13; 523/160.161
See application file for complete search history.

(56) References Cited

U.S. PATENT DOCUMENTS

| | | | | |
|---|---|---|---|---|
| 6,012,809 | A * | 1/2000 | Ikeda et al. | 347/96 |
| 6,084,619 | A * | 7/2000 | Takemoto et al. | 347/100 |
| 6,328,438 | B1 * | 12/2001 | Ozawa | 347/96 |
| 7,517,074 | B2 * | 4/2009 | Hakamada et al. | 347/100 |
| 2003/0069329 | A1 * | 4/2003 | Kubota et al. | 523/160 |
| 2006/0203056 | A1 * | 9/2006 | Furukawa et al. | 347/96 |
| 2008/0012894 | A1 * | 1/2008 | Ono | 347/102 |
| 2009/0130320 | A1 * | 5/2009 | Kawakami et al. | 347/105 |
| 2010/0245508 | A1 | 9/2010 | Ikeda et al. | |

FOREIGN PATENT DOCUMENTS

| | | |
|---|---|---|
| EP | 0 581 135 A1 | 2/1994 |
| EP | 1308491 | 5/2003 |
| JP | 6057192 A | 3/1994 |
| JP | 06092009 | 4/1994 |
| JP | 6092009 A | 4/1994 |
| JP | 06099576 | 4/1994 |
| JP | 6099576 A | 4/1994 |
| JP | 6128514 A | 5/1994 |
| JP | 07001837 | 1/1995 |
| JP | 8020161 A | 1/1996 |
| JP | 9-207424 | 8/1997 |
| JP | 10287035 | 10/1998 |
| JP | 2008208153 | 9/2008 |
| JP | 09207424 | 3/2010 |

OTHER PUBLICATIONS

European Search Report EP-10-15-7005 (6 pages).

* cited by examiner

*Primary Examiner* — Manish S Shah
(74) *Attorney, Agent, or Firm* — Lucas & Mercanti, LLP

(57) ABSTRACT

Disclosed is a method for forming an image with an ink-jet recoding method which forms the image on a coated printing paper by employing an ink containing water in an amount of 20 to 90% weight based on the total weight of the ink, a pigment and a resin, the method containing the sequential steps of: applying an aqueous processing solution on the coated printing paper; drying the aqueous processing solution applied on the coated printing paper; and ejecting droplets of the ink on the coated printing paper, wherein the aqueous processing solution is capable of aggregating the ink or increasing a viscosity of the ink, and the coated printing paper is heated from 40 to 60° C. during the step of ejecting the droplets of the ink.

19 Claims, 3 Drawing Sheets

IMAGE FORMING METHOD

CROSS REFERENCE TO RELATED APPLICATIONS

This application is based on Japanese Patent Application No. 2009-073510 filed on Mar. 25, 2009 with Japan Patent Office, the entire content of which is hereby incorporated by reference.

TECHNICAL FIELD

The present invention relates to an image forming method which employs an ink-jet recording method.

BACKGROUND

In recent years, since ink-jet recording enables to form an image simply and less expensively, it has been applied to various printing fields such as photography, various types of printing, marking, and special printing such as color filters. Specifically, the performances of the ink-jet recording apparatus and the properties of the ink-jet ink have been markedly improved distinctly. Therefore, it has become possible to provide an ink-jet image of high quality comparable to an image produced by conventional silver halide photography.

However, in order to acquire an image of high quality, an expensive paper such as an exclusive recording medium paper is required. There is growing a need to achieve an image of high quality even by using non-expensive recording media such as a plain paper, a coated printing paper or a coated paper.

When image formation is tried onto a plain paper with an ink jet recording method, it is known that the following quality deterioration will be caused: strike-through (phenomenon in which an ink penetrate through to the wire side of paper), feathering (phenomenon in which an ink spreads in a cross direction along with fiber), a cockling (phenomenon in which a wrinkle is produced in a wave shape when paper absorbs the solvent in an ink), and curling of paper.

Moreover, when image formation is tried onto a coated printing paper with an ink-jet recording method, it is known that the following quality deterioration will be caused especially in the solid image portion which is produced by uniform image printing: mottling (phenomenon in which adjacent ink droplets are gathered and are fixed to result in producing irregular unevenness), bleeding (phenomenon in which ink droplets are mixed and a smear is produced in the boundary area of the image having a different color, it is also called "color bleeding"). These are phenomena caused by the poor ink absorptive property of the coated printing paper, and, for this reason, it is said that the coated printing paper is unsuitable as a recording medium of the ink-jet recording apparatus having a line head system capable for high-speed printing.

Moreover, in order to improve the above-mentioned print quality, ink-jet recording methods containing the step of applying a processing solution to a recording medium prior to image formation are described in the following Patent documents 1-4. Although the aggregation property of the ink is increased to result in improvement of image quality by applying the ink-jet recording methods containing the step using these processing solutions, there remain major problems that these methods will cause deterioration of glossiness or deterioration of cockling. Further, the ink-jet recording methods described in these documents have a problem of bleeding of the ejected ink.

Further, it is disclosed in the Patent document 5 that bleeding is improved by the way of printing while warming a recording medium using the ink-jet ink containing a resin neutralized with an amine.

Patent document 1: Japanese Patent Application Publication (JP-A) No. 06-092009

Patent document 2: JP-A No. 06-099576

Patent document 3: JP-A No. 07-001837

Patent document 4: JP-A No. 09-207424

Patent document 5: JP-A No. 2008-208153

SUMMARY

The present invention was made in view of the above-mentioned problems to be solved. An object of the present invention is to provide an image forming method which enables to produce an image of high quality with having a high-speed printing aptitude, preventing mottling and bleeding and excellent in glossiness, sharpness and anti-cockling property on a non-expensive recording medium such as a coated printing paper.

As a result of the investigation by the present inventors to solve the above-described problems, it was found that the image forming method having the following composition can achieve to produce an image of high-quality. One of the embodiments of the present invention includes a method for forming an image with an ink-jet recoding method which forms the image on a coated printing paper by employing an ink comprising water in an amount of 20 to 90 weight % based on the total weight of the ink, a pigment and a resin. The method comprises the following steps in that order: (i) applying an aqueous processing solution on the coated printing paper with a roller coater; (ii) drying the aqueous processing solution applied on the coated printing paper; and then, (iii) ejecting droplets of the ink on the coated printing paper, wherein the aqueous processing solution is capable of aggregating an ingredient of the ink or increasing a viscosity of the ink. By application of this method, an image of high quality which is prevented from formation of mottling and bleeding, and excellent in glossiness, sharpness and anti-cockling property can be formed on a non-expensive recording medium such as a coated printing paper with a high-speed printing aptitude.

The object of the present invention can be achieved with the embodiments described below.

1. A method for forming an image with an ink-jet recoding method which forms the image on a coated printing paper by employing an ink comprising water in an amount of 20 to 90 weight % based on the total weight of the ink, a pigment and a resin, the method comprising the sequential steps of:

applying an aqueous processing solution on the coated printing paper;

drying the aqueous processing solution applied on the coated printing paper; and ejecting droplets of the ink on the coated printing paper, wherein the aqueous processing solution is capable of aggregating the ink or increasing a viscosity of the ink, and the coated printing paper is heated from 40 to 60° C. during the step of ejecting the droplets of the ink.

2. The method for forming an image with an ink-jet recoding method of the aforesaid item 1, wherein a content of water in the aqueous processing solution after applied on the coated printing paper is reduced in the range of 0.1 weight % to 30 weight % based on a content of water contained in the aqueous processing solution by the drying step, and then, the ejection step of the ink is carried out.

3. The method for forming an image with an ink-jet recoding method of the aforesaid item 1, wherein the aqueous processing solution contains at least one of the group consisting of a polyvalent metal salt, an acid and a cationic resin.

4. The method for forming an image with an ink-jet recoding method of the aforesaid item 1, wherein the aqueous processing solution contains a polyvalent metal salt.

5. The method for forming an image with an ink-jet recoding method of the aforesaid item 3, wherein the polyvalent metal salt contains at least a cation selected from the group consisting of a calcium ion, a copper ion, a nickel ion, a magnesium ion, a barium ion, an aluminium ion, an iron ion, a chromium ion, a yttrium ion and a zirconium ion.

6. The method for forming an image with an ink-jet recoding method of the aforesaid item 3, wherein the polyvalent metal salt contains at least an anion selected from the group consisting of a carbonate ion, a sulfate ion, a nitrate ion, a chloride ion, an organic acid ion, a borate ion and a phosphate anion.

7. The method for forming an image with an ink-jet recoding method of the aforesaid item 1, wherein the aqueous processing solution contains an organic acid having a pKa value of 4.5 or less.

8. The method for forming an image with an ink-jet recoding method of the aforesaid item 3, wherein the acid is at least one selected from the group consisting of hydrochloric acid, nitric acid, sulfuric acid, phosphoric acid, carbonic acid, citric acid, isocitric acid, oxalic acid, maleic acid, fumaric acid, malonic acid, succinic acid, glutaric acid, adipic acid, phthalic acid, isophthalic acid, terephthalic acid, citric acid, 2-pyrrolidone-5-carboxylic acid, benzoic acid, a benzoic acid derivative, salicylic acid, ascorbic acid, malic acid, benzenesulfonic acid, a benzenesulfonic acid derivative, pyruvic acid and oxalacetic acid.

9. The method for forming an image with an ink-jet recoding method of the aforesaid item 1, wherein the resin has an acid group which is neutralized with an amine.

10. The method for forming an image with an ink-jet recoding method of the aforesaid item 9, wherein the resin having an acid group which is neutralized with an amine has a weight average molecular weight of 3,000 to 30,000.

11. The method for forming an image with an ink-jet recoding method of the aforesaid item 9, wherein the resin having an acid group which is neutralized with an amine exhibits an acid value of 60 to 300 mgKOH/g.

12. The method for forming an image with an ink-jet recoding method of the aforesaid item 1, wherein the resin contained in the ink is a water soluble resin.

13. The method for forming an image with an ink-jet recoding method of the aforesaid item 1, wherein the water soluble resin has a weight average molecular weight of 5,000 or more.

14. The method for forming an image with an ink-jet recoding method of the aforesaid item 3, wherein the cationic resin is at least one selected from the group consisting of polyallylamine, polyamine, cation modified acrylate resin, cation modified methacrylic resin, cation modified vinyl resin, cationic polyurethane resin and a copolymer thereof.

15. The method for forming an image with an ink-jet recoding method of the aforesaid item 1, wherein the ink contains an organic solvent in an amount of 20 to 60 weight % based on a total weight of the ink.

16. The method for forming an image with an ink-jet recoding method of the aforesaid item 1, wherein the applying step of the aqueous processing solution is conducted two times or more, then the drying step of the aqueous processing solution is carried out.

17. The method for forming an image with an ink-jet recoding method of the aforesaid item 1, wherein the applying step of the aqueous processing solution is conducted with a method selected from the group consisting of a roller coating method, an ink-jet method, a curtain coating method and a spray coating method.

18. The method for forming an image with an ink-jet recoding method of the aforesaid item 1, wherein the drying step of the aqueous processing solution is conducted with a heater, a warm air dryer, or a hating roller.

19. The method for forming an image with an ink-jet recoding method of the aforesaid item 1, wherein the drying step of the aqueous processing solution is conducted with a heater and a warm air dryer. 1.

One of the embodiments of the present invention includes a method for forming an image with an ink-jet recoding method which forms the image on a coated printing paper by employing an ink comprising water in an amount of 20 to 90 weight % based on the total weight of the ink, a pigment and a resin, the method comprising the sequential steps of:

applying an aqueous processing solution on the coated printing paper;

drying the aqueous processing solution applied on the coated printing paper; and ejecting droplets of the ink on the coated printing paper, wherein the aqueous processing solution is capable of aggregating the ink or increasing a viscosity of the ink, and the coated printing paper is heated from 40 to 60° C. during the step of ejecting the droplets of the ink.

By the present invention, it was achieved to provide a an image forming method which enables to produce an image of high quality which is prevented from formation of mottling and bleeding, and excellent in glossiness, sharpness and anti-cockling property on a non-expensive recording medium such as a coated printing paper with a high-speed printing aptitude. In particular, it was achieved to provide an image forming method which enables to prevent the bleeding of the ejected ink on a coated printing paper.

DESCRIPTION OF THE PREFERRED EMBODIMENTS

Figure 1:
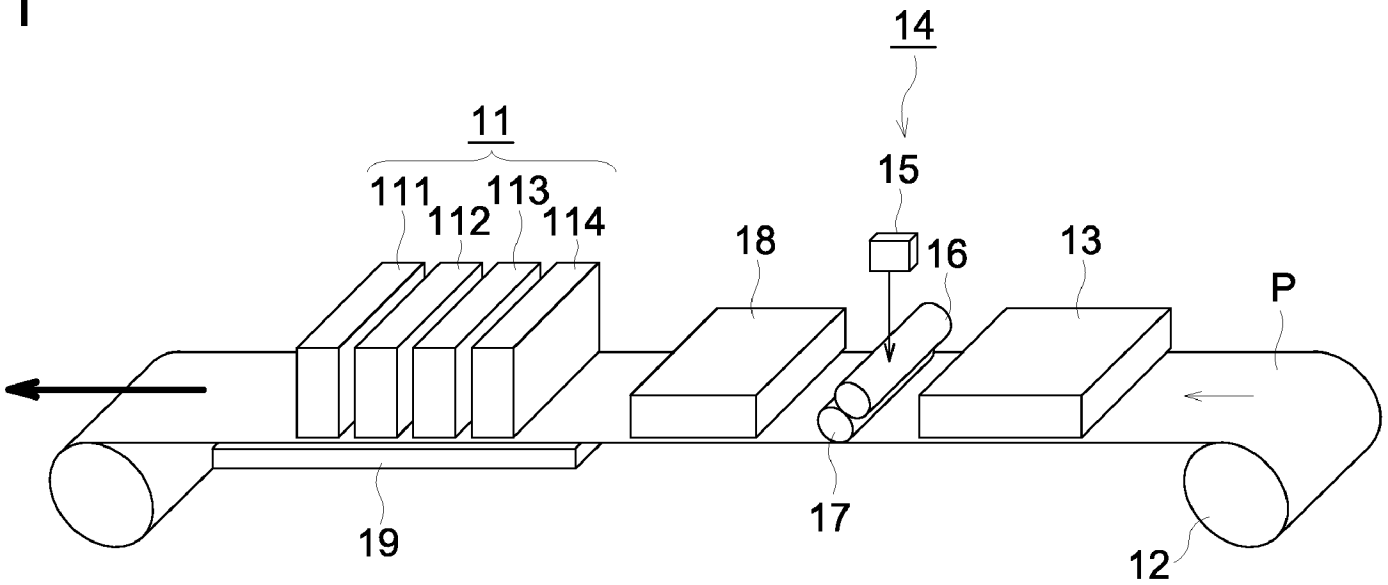
FIG. 1 is a schematic drawing showing an example of a single pass type (line-head type) ink-jet recording apparatus which is applicable to the image forming method of the present invention.

The embodiments to carry out the present invention will be described in detail.

Hereafter, the details of each structural element concerning the image forming method of the present invention will be described.

<<Ink-Jet Ink>>

The ink-jet ink of the present invention (from now on, it is also called simply as "an ink") contains at least a resin, a pigment and water, and the water content in the ink is in the range of 20 weight % to 90 weight %. Moreover, to the ink of the present invention may be added various additives, such as a surfactant, according to the object and application.

(Resin)

The resin of the present invention is a resin which is not adsorbed to a pigment. As the resin of the present invention which is not adsorbed to a pigment, it may be used a water soluble resin having an acid group neutralized with an amine, or a water dispersed resin (it is called a latex resin).

<Resin Having an Acid Group Which is Neutralized with an Amine>

The resin having an acid group which is neutralized with an amine and used in the present invention has an acidic functional group such as a carboxyl group or a sulfa group in the resin, and the acidic functional group in the resin is neutralized with an amine.

Examples of the resin include the following compound. A portion of a resin made of an acrylic system, a styrene-acrylic system, an acrylonitrile-acrylic system, a vinyl acetate-acrylic system, a polyurethane system, or a polyester system is modified with an acid such as a carboxyl group and a sulfa group, and the targeted resin can be obtained by neutralizing the modified resin with an amine.

Since the amine compound contained in the resin is easily vaporized by heating or warming during the drying step, when the resin having an acid group neutralized with an amine is heated, only the resin having an acidic group will remain. It is assumed that this resin having an acidic group will prevent the flow of the ink, and this property will contribute to the improvement of an image quality. Examples of the amine compound used for neutralization include: ammonia, methylamine, dimethylamine, ethylamine, diethylamine and ethylmethylamine. Among them, ammonia is most preferable.

The water soluble resin which has an acid group can be obtained by polymerizing a monomer. Examples of the monomer include: acrylic acid, methacrylic acid, itaconic acid, fumaric acid, and an acid derivative of styrene. Although the polymerization methods are not particularly limited, the resin used in the present invention is preferably polymerized with radical copolymerization of at lease one of these monomers. Moreover, it may be possible to carry out copolymerization with other monomers if needed.

As for the weigh average molecular weight of the water soluble resin which has an acid group, it is preferable to be 3,000 or more from the viewpoints of improving effect of the image quality of the present invention, and it is preferable to be 30,000 or less from the viewpoints of the ejection property and viscosity. More preferably, it is from 10,000 to 20,000. Moreover, it is preferable that an acid value of the resin is from 60 mgKOH/g or more to less than 300 mgKOH/g.

The preferable amount of the water soluble resin which has an acid group is from 2.0 to 10 weight % based on the total weight of the ink and, and it is more preferably from 3.0 to 6.0 weight %.

<Water Dispersed Resin (Latex Resin)>

The water dispersed resin used in the present invention is made of a resin having a water soluble functional group such as a carboxylic group or a sulfo group. Examples of the water dispersed resin are made of at least one of the following group consisting of: a vinyl acetate system, a styrene-butadiene system, a vinyl chloride system, an acrylic-styrene system, a butadiene system, a styrene system, or it may be a mixture of these resins.

It is more preferable to use a resin having a carboxylic group which has a small dissociation rate from the viewpoint of producing high speed aggregation effect of the water dispersed resin. Since a carboxylic acid group tends to be influenced by a pH change, a dispersion state changes easily and its aggregation property is high. Examples of a resin component used for a water dispersed resin in the ink are: an acrylic resin, a vinyl acetate resin, a styrene butadiene resin, a vinyl chloride resin, an acrylic styrene resin, a butadiene resin and styrene resin. The change of a dispersion state in response to the pH change of the water dispersed resin can be adjusted with the content ratio of the composition ingredient in water dispersibility resin which has carboxylic acid groups, such as acrylic ester, and can be adjusted also with the anionic surfactant used as a dispersing agent. As for the resin component of the water dispersed resin, it is preferable that it is a polymer having both a hydrophilic portion and a hydrophobic part in the molecule. By having a hydrophobic part, it is possible that a hydrophobic part will be orientated to the inside of the water dispersed resin, and a hydrophilic portion will be effectively orientated to the outside of the water dispersed resin. As a result, the change of a dispersion state in response to the pH change of a liquid will become larger, and aggregation of the ink will be performed more efficiently.

Examples of a water dispersed resin emulsion commercially available include: Joncryl 537 and 7640 (styrene-acrylic resin emulsion, made by Johnson Polymer Co., Ltd.), Microgel E-1002 and E-5002 (styrene-acrylic resin emulsion, made by Nippon Paint Co., Ltd.), Voncoat 4001 (acrylic resin emulsion, made by Dainippon Ink and Chemicals Co., Ltd.), Voncoat 5454 (styrene-acrylic resin emulsion, made by Dainippon Ink and Chemicals Co., Ltd.), SAE-1014 (styrene-acrylic resin emulsion, made by Zeon Japan Co., Ltd.), Jurymer ET-410 (acrylic resin emulsion, made by Nihon Junyaku Co., Ltd.), Aron HD-5 and A-104 (acrylic resin emulsion, made by Toa Gosei Co., Ltd.), Saibinol SK-200 (acrylic resin emulsion, made by Saiden Chemical Industry Co., Ltd.), and Zaikthene L (acrylic resin emulsion, made by Sumitomo Seika Chemicals Co., Ltd.). However, the water dispersed resin emulsion is not limited to these examples.

The content of the water dispersed resin added in the ink of the present invention is preferably from 2-40 weight % based on the total weight of the ink, and it is more preferably from 5-30 weight %, and it is still more preferably from 10-25 weight %.

The volume average particle size of the water dispersed resin is preferably from 10 nm-1 μm, it is more preferably from 10-500 nm, and it is still more preferably from 20-200 nm, and especially preferably it is from 50-200 nm.

When the particle size is equal to or less than 10 nm, significant effects in improving the image quality or enhancing transfer characteristics of the image cannot be fully expected, even if aggregation occurs. When the particle size is equal to or greater than 1 μm, there may be a possibility that the ejection characteristics of the ink from the ink-jet head or the storage stability of the ink will be deteriorated. In addition, there are no specific restrictions to the volume average particle size distribution of the polymer particles, and it is possible that the polymer particles have a broad volume average particle size distribution or the polymer particles have a volume average particle size distribution of monodisperse type.

Moreover, two or more types of water dispersed resins may be used in combination in the ink.

Examples of a pH adjuster added to the ink in the present invention include an organic base and an inorganic alkali base, as a neutralizing agent. In order to improve storage stability of the ink for inkjet recording, the pH adjuster is preferably added in such a manner that the ink for inkjet recording has the pH value in the range of 6 to 10.

<Other Resin>

Moreover, the ink of the present invention may contain other resin different from the above-described water soluble resin neutralized with an amine and the water dispersed resin according to various objects. Two or more sorts of resins may be added, they may be added as a copolymer. Further, they may be added dispersed in the state of an emulsion. When they are dispersed in the state of an emulsion, the average particle diameter of the resin particles is preferably 300 nm or less from the viewpoint of not spoiling ejection property of an ink-jet recording method. In the case of a water soluble polymer, although the composition or a molecular weight is not specifically limited, but the weight average molecular weight is preferably 50,000 or less.

(Solvent)

The ink of the present invention contains a pigment, a resin and a solvent. Water is cited as a desirable solvent. In the present invention, the content of water to the whole ink is preferably from 20 weight % to 70 weight %. It is more preferable that the content of water is from 30 weight % to 50 weight %.

As a solvent of the ink, for the purposes of improving the ejection property of the ink or adjusting the ink physical properties, the ink preferably contains a water soluble organic solvent in addition to water. As long as the effect of the present invention is not damaged, there is no restriction in particular in the type of the water soluble organic solvent. Examples of the solvent include: glycerin, propylene glycol, dipropylene glycol, tripropylene glycol, tetrapropylene glycol, polypropylene glycol, ethylene glycol, diethylene glycol, triethylene glycol, tetraethylene glycol, polyethylene glycols, decaglyserol, 1,4-butanediol, 1,3-butanediol, 1,2,6-hexanetriol, 2-pyrrolidinone, dimethylimidazolidinone, ethylene glycol mono-butyl ether, diethylene glycol monomethyl ether, diethylene glycol monoethyl ether, diethylene glycol monopropyl ether, diethylene glycol mono-butyl ether, triethylene glycol monomethyl ether, triethylene glycol monoethyl ether, triethylene glycol mono-propyl ether, triethylene glycol mono-butyl ether, tetraethylene glycol monomethyl ether, tetraethylene glycol monoethyl ether, propylene glycol mono-butyl ether, dipropylene glycol monomethyl ether, dipropylene glycol monoethyl ether, dipropylene glycol monopropyl ether, diethylene glycol monobutyl ether, tripropylene glycol monomethyl ether, tripropylene glycol monoethyl ether, tripropylene glycol monopropyl ether, tripropylene glycol monobutyl ether, tetrapropylene glycol monomethyl ether, diethylene glycol diethyl ether, diethylene glycol dibutyl ether, triethylene glycol diethyl ether, triethylene glycol dibutyl ether, dipropylene glycol dibutyl ether, tri propylene glycol dibutyl ether, 3-methyl 2,4-pentanediol, diethylene-glycol-monoethyl ether acetate, 1,2-hexanediol, 1,2-pentanediol and 1,2-butanediol.

Although there is no restriction in particular to the amount of the organic solvent in the ink, it is preferable that it is from 20 weight % to 60 weight % to the whole ink.

(Pigment)

Examples of the pigment usable in the present invention include those commonly known without any limitation, and either a water-dispersible pigment or an oil-dispersible pigment is usable. For example, an organic pigment such as an insoluble pigment or a lake pigment, as well as an inorganic pigment such as carbon black, is preferably usable.

Examples of the insoluble pigments are not particularly limited, but preferred are an azo, azomethine, methine, diphenylmethane, triphenylmethane, quinacridone, anthraquinone, perylene, indigo, quinophthalone, isoindolinone, isoindoline, azine, oxazine, thiazine, dioxazine, thiazole, phthalocyanine, or diketopyrrolopyrrole dye.

Specific pigments which are preferably usable are listed below.

Examples of pigments for magenta or red include: C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 44, C. I. Pigment Red 149, C. I. Pigment Red 166, C. I. Pigment Red 177, C. I. Pigment Red 178, and C. I. Pigment Red 222.

Examples of pigments for orange or yellow include: C. I. Pigment Orange 31, C. I. Pigment Orange 34, C. I. Pigment Yellow 12, C. I. Pigment Yellow 13, C. I. Pigment Yellow 14, C. I. Pigment Yellow 15, C. I. Pigment Yellow 15:3, C. I. Pigment Yellow 17, C. I. Pigment Yellow 74, C. I. Pigment Yellow 93, C. I. Pigment Yellow 128, C. I. Pigment Yellow 94, and C. I. Pigment Yellow 138.

Examples of pigments for green or cyan include: C. I. Pigment Blue 15, C. I. Pigment Blue 15:2, C. I. Pigment Blue 15:3, C. I. Pigment Blue 16, C. I. Pigment Blue 60, C.I. and C. I. Pigment Green 7.

In addition to the above pigments, when red, green, blue or intermediate colors are required, it is preferable that the following pigments are employed individually or in combination thereof. Examples of employable pigments include: C. I. Pigment Red 209, 224, 177, and 194, C. I. Pigment Orange 43, C.I. Vat Violet 3, C. I. Pigment Violet 19, 23, and 37, C. I. Pigment Green 36, and 7, C. I. Pigment Blue 15:6.

Further, examples of pigments for black include: C. I. Pigment Black 1, C. I. Pigment Black 6, and C. I. Pigment Black 7.

It is preferable that the pigment used in the invention is dispersed employing a homogenizer together with a dispersing agent and necessary additives for various desired purposes. Commonly known homogenizers are usable, including a ball mill, a sand mill, a line mill, or a high pressure homogenizer.

The average particle size of the pigment dispersion employed in the ink of the present invention is preferably from 10 nm to 200 nm, it is more preferably from 10 nm to 100 nm, and it is still more preferably from 10 nm to 50 nm.

Particle diameter measurement of the pigment dispersion is carried out with a commercially available particle diameter analyzer employing a light scattering method, an electrophoretic method, or a laser Doppler method. It is also possible to conduct the measurement via photographic particle images of at least 100 particles with a transmission electron microscope, followed by statistically processing these images using an image analyzing software such as Image-Pro (produced by Media Cybernetics, Inc.).

(Surfactant)

It is preferable that the ink of the present invention contains a surfactant in order to improve an ink ejection property or wettability. As a surfactant used, a cationic, anionic, amphoteric, and nonionic surfactant all can be used.

As examples of a surfactant used, although they are not specifically limited, the following can be cited.

Examples of a cationic surfactant include: an aliphatic amine salt, an aliphatic quarternary ammonium salt, a benzalkonium salt, benzethonium chloride, a pyridinium salt, an imidazolinium salt.

Examples of an anionic surfactant include: an aliphatic acid soap, an N-acyl-N-methyl glycin salt, an N-acyl-N-methyl-β-alanine salt, an N-acylglutamate, an acylated peptide, an alkylsulfonic acid salt, an alkylbezenesulfonic acid salt, an alkynaphthalenesulfonic acid salt, a dialkylsulfo succinate, alkylsulfo acetate, α-olefin sulfonate, N-acyl-methyl taurine, a sulfonated oil, a higher alcohol sulfate salt, a secondary higher alcohol sulfate salt, an alkyl ether sulfate, a secondary higher alcohol ethoxysulfate, a polyoxyethylene alkylphenyl ether sulfate, a monoglysulfate, an aliphatic acid alkylolamido sulfate salt, an alkyl ether phosphate salt and an alkyl phosphate salt.

Examples of an amphoteric surfactant include: a carboxybetaine type, a sulfobetaine type, an aminocarboxylate salt and an imidazolium betaine. Examples of a nonionic surfactant include: a polyoxyethylene secondaryalcohol ether, a polyoxyethylene alkylphenyl ether, a polyoxyethylene sterol ether, a polyoxyethylenelanolin derivative polyoxyethylene polyoxypropylene alkyl ether, a polyoxyethyleneglycerine aliphatic acid ester, a polyoxyethylene castor oil, a hydrogenated castor oil, a polyoxyethylene sorbitol aliphatic acid ester, a polyethylene glycols aliphatic acid ester, an aliphatic acid monoglyceride, a polyglycerine aliphatic acid ester, a sorbitan aliphatic acid ester, a propylene glycol aliphatic acid ester, a cane sugar aliphatic acid ester, an aliphatic acid alkanol amide, a polyoxyethylene aliphatic acid amide, a polyoxyethylene alkylamine, an alkylamine oxide, an acetyleneglycol, acetylene alcohol.

It is preferable that a part of these surfactants is furthermore substituted with a fluorine atom or a silicon atom from a viewpoint of reducing the surface tension.

These surfactants and solvents may be used solely, or they may be used in combination of the plural.

(Other Additives)

In order to achieve various purposes, the ink of the present invention may contain various additives. Examples of various properties to be enhanced are: such as ejection stability, adaptability to printing heads and ink cartridges, storage stability, and image retention properties, it is possible, if needed, to appropriately select and employ various types of commonly known additives in the ink of the invention other than those described above. Included are additives such as polysaccharides, a viscosity modifier, a specific resistance controlling agent, a film forming agent, an UV absorbing agent, an antioxidant, an anti-discoloring agent, an antiseptic agent, or an anti-rusting agent. Examples thereof include minute oil droplets of liquid paraffin, dioctyl phthalate, tricresyl phosphate, or silicone oil; UV absorbing agents described in JP-A Nos. 57-74193, 57-87988, and 62-261476; anti-discoloring agents described in JP-A Nos. 57-74192, 57-87989, 60-72785, 61-146591, 1-95001, and 3-13376, as well as optical brightening agents described in JP-A Nos. 59-42993, 59-52689, 62-280069, 61-242871, and 4-219266.

<<Aqueous Processing Solution Capable of Aggregating or Thickening Ink-Jet Ink>>

In the present invention, the aqueous processing solution which is capable of aggregating the ink-jet ink ingredients or thickening (increasing the viscosity) the ink-jet ink indicates an aqueous solution which operates on the solid components dissolved in the ink so as to decrease the solubility of the solid components. Hereafter, it is also called as "an aqueous processing solution of the present invention." The preferable aqueous processing solution is an aqueous solution containing at least one of a polyvalent metal salt, an acid and a cationic resin. By making contact the liquid containing a polyvalent metal salt with an ink, the cation contained in the aqueous processing solution will interact with pigment, an anion in the resin or ingredients in the ink to result in aggregation sedimentation of the ingredients of the ink. This can prevent bleeding or mottling of the ink.

The main solvent contained in the aqueous processing of the present invention is preferably water, and a water-soluble organic solvent or a surfactant may be contained when needed.

As a polyvalent metal salt which can be applied to an aqueous processing solution of the present invention, a salt of metal with a valence of 2 or more can be used. Examples of a preferable cation include: a divalent metal ion such as $Ca^{2+}$, $Cu^{2+}$, $Ni^{2+}$, $Mg^{2+}$, $Zn^{2+}$ and $Ba^{2+}$; a trivalent metal ion such as $Al^{3+}$, $Fe^{3+}$, $Cr^{3+}$and $Y^{3+}$; and a tetravalent metal ion such as $Zr^{4+}$. A more preferable cation is $Ca^{2+}$and $Al^{3+}$.

As a type of salt, well-known salts can be used. Examples are salts of: carbonic acid, sulfuric acid, nitric acid, hydrochloric acid, an organic acid, boric acid and phosphoric acid. It is also preferable to adjust a pH value if needed for dissolving the polyvalent metal salt. As a preferable salt, calcium nitrate, calcium chloride, aluminium nitrate and aluminium chloride are especially cited from the viewpoints of achieving the effects of the present invention and handling.

As a kind of an acid which can be applied to an aqueous processing solution of the present invention, there is no specific limitation. It is preferable to use an acid having of a pKa value smaller than 4.5. Example of such acid include: inorganic acids such as hydrochloric acid, nitric acid, sulfuric acid, phosphoric acid and carbonic acid; organic acids such as carboxylic acid and sulfonic acid. More preferable acids are organic acids having a pKa value smaller than 4.5. The following acids are specifically more preferable: citric acid, isocitric acid, oxalic acid, maleic acid, fumaric acid, malonic acid, succinic acid, glutaric acid, adipic acid, phthalic acid, isophthalic acid, terephthalic acid, citric acid, 2-pyrrolidone-5-carboxylic acid, benzoic acid, a benzoic acid derivative, salicylic acid, ascorbic acid, malic acid, benzenesulfonic acid, a benzenesulfonic acid derivative, pyruvic acid and oxalacetic acid.

Although there is no restriction in particular as a kind of a cationic resin having a positive charge and applicable to an aqueous processing solution of the present invention, a resin having a quaternary amine is preferable from the ability to acquire a high effect by a small amount of addition in the processing solution.

As a group which gives a resin cationic property, it is preferable to incorporate a metallic cation or a nitrogen cation in the resin. For example, polyallylamine, polyamine, cation modified acrylate resin, cation modified methacrylic resin, cation modified vinyl resin, cationic polyurethane resin, a copolymer thereof can be cited.

It is preferable to incorporate in the aqueous processing solution of the present invention the compound such as a surfactant or a solvent which adjust the liquid properties other than the above-mentioned compound which aggregates the solid ingredients of the ink or increasing a viscosity of the ink.

Examples of the solvent which can be incorporated in the aqueous processing solution of the present invention include: glycerin, propylene glycol, dipropylene glycol, tripropylene glycol, tetrapropylene glycol, polypropylene glycol, ethylene glycol, diethylene glycol, triethylene glycol, tetraethylene glycol, polyethylene glycols, decaglyserol, 1,4-butanediol, 1,3-butanediol, 1,2,6-hexanetriol, 2-pyrrolidinone, dimethylimidazolidinone, ethylene glycol mono-butyl ether, diethylene glycol monomethyl ether, diethylene glycol monoethyl ether, diethylene glycol mono-propyl ether, diethylene glycol mono-butyl ether, triethylene glycol monomethyl ether, triethylene glycol monoethyl ether, triethylene glycol monopropyl ether, triethylene glycol mono-butyl ether, tetraethylene glycol monomethyl ether, tetraethylene glycol monoethyl ether, propylene glycol mono-butyl ether, dipropylene glycol monomethyl ether, dipropylene glycol monoethyl ether, dipropylene glycol monopropyl ether, diethylene glycol monobutyl ether, tripropylene glycol monomethyl ether, tripropylene glycol monoethyl ether, tripropylene glycol monopropyl ether, tripropylene glycol monobutyl ether, tetrapropylene glycol monomethyl ether, diethylene glycol diethyl ether, diethylene glycol dibutyl ether, triethylene glycol diethyl ether, triethylene glycol dibutyl ether, dipropylene glycol dibutyl ether, tri propylene glycol dibutyl ether, 3-methyl 2,4-pentanediol, diethylene-glycol-monoethyl ether acetate, 1,2-hexanediol, 1,2-pentanediol and 1,2-butanediol. Although there is no restriction in particular to the content of an organic solvent, it is preferable that it is in the range of 20 weight % to 60 weight % with respect to the whole water processing solution.

In order to adjust the suitable liquid properties for the application condition of a processing solution onto a coated printing paper, it is preferable to use plural solvents mixed together. It is specifically preferable, from the viewpoints of coating characteristics, drying characteristics, image quality, and safety, that water is included as a part of solvents.

It is preferable that the aqueous processing solution contains a surfactant in order to adjust the suitable liquid properties for the application condition onto a coated printing paper. As a surfactant which can be applied to the present invention include: a cationic surfactant, an anionic surfactant, an amphoteric surfactant and a nonionic surfactant. For example, the similar surfactants as shown for the ink of the present invention can be also used for the aqueous processing solution.

Further, the aqueous processing solution of the present invention may contain a variety of additives for the various purposes. Examples of such additives include: polysaccharides, a viscosity modifier, a specific resistance controlling agent, a film forming agent, an UV absorbing agent, an antioxidant, an anti-discoloring agent, an antiseptic agent, or an anti-rusting agent. Specific examples thereof include: minute oil droplets of liquid paraffin, dioctyl phthalate, tricresyl phosphate, or silicone oil; UV absorbing agents; anti-discoloring agents; and optical brightening agents.

As an application way of the aqueous processing solution, any conventionally known methods can be used. Specific examples of an application way include: a roller coating, an ink-jet application, a curtain coating and a spray coating. There is no specific restriction in the number of times with which the aqueous processing solution is applied. It may be applied at one time, or it may be applied in two times or more. Application in two times or more is preferable, since cockling of the coated printing paper can be prevented and the film formed by the surface processing solution will produce a uniform dry surface having no wrinkle by applying in 2 steps or more.

Especially a roller coating method is preferable because this coating method does not need to take into consideration of ejection properties and it can apply the aqueous processing solution homogeneously to a recording medium. In addition, the amount of the applied processing solution with a roller or with other means to a recording medium can be suitably adjusted by controlling: the physical properties of the processing solution; and the contact pressure of a roller in a roller coater to the recording medium and the rotational speed of a roller in a roller coater which is used for a coater of the processing solution. As an application area of the processing solution of the present invention, it may be possible to apply only to the printed portion, or to the entire surface of both the printed portion and the non-printed portion. However, when the processing solution is applied only to the printed portion, unevenness may occur between the application area and a non-application area caused by swelling of cellulose contained in the coated printing paper with the water in the processing solution followed by making it dry. Then, from the viewpoint of drying uniformly, it is preferable to apply a processing solution to the entire surface of a coated printing paper, and roller coating can be preferably used as a coating method to the whole surface.

A preferable amount of the aqueous processing solution applied to a coated printing paper is from 0.5 to 20 ml/m$^2$, and more preferably it is from 5 to 15 ml/m$^2$.

<<Coated Printing Paper>>

A coated printing paper of the present invention refers to a small water absorptive coated paper which is coated a coating layer containing a white pigment and a binder such as starch on the back and front of the paper. The coated printing paper refers to a paper used for process printing or offset printing. In the image forming method of the present invention, one of the specific features is to apply an aqueous processing solution capable of aggregating or thickening the ink-jet ink on the surface of the coated printing paper and then to dry the aqueous processing solution prior to forming an image with an ink-jet recording method.

As a coated printing paper used for the present invention, it is preferable that the amount of transfer of the aqueous solution during 500 ms is from 0.05 to 6.0 ml/m$^2$, the aqueous solution being adjusted to have a surface tension of 20 to 40 mN/m using a surfactant.

One of the features of the image forming method of the present invention is to apply an aqueous processing solution of the present invention on the surface of the coated printing paper and subsequently to dry the aqueous processing solution. To dry the aqueous processing solution means to dry to the degree in which the ink droplet which has reached to the coated printing paper does not spread by visual checking, when an ink-jet recording apparatus is used for the coated printing paper in the next step. In particular, it is preferable to achieve the condition that an amount of water in the aqueous processing solution applied to the coated printing paper is reduced to in the range of 0.1 weight % to 30 weight % based on a content of water initially contained in the aqueous processing solution. More preferably, it is reduced to 1 weight % to 20 weight %. Still more preferably, it is reduced to 3 weight % to 15 weight %.

By reducing the water content in the applied water processing solution in the range, it is possible to prevent the bleeding of the ejected ink. Since the bleeding of the ejected ink is conspicuous in the portion of small amount of ink ejection compared with the portion of the amount of ink ejection, the bleeding in the portion of small amount of ink ejection can be effectively prevented by the image forming method of the present invention.

The measuring method of the reduction rate of a content of water can be determined by measuring the weight of the coated printing paper immediately after applying the aqueous processing solution of the present invention, and the weight after drying the coated printing paper.

Although any one of a natural drying, a heater, a warm air dryer and a heat roller can be used to dry the aqueous processing solution, a heater, a warm air dryer or a heat roller is preferably used as a heating means. When the aqueous processing solution is dried with a heater, the heater may be used for excusive use, or it may be possible to use for multiple purpose used as a warming means of the coated printing paper which will be described later. Further, in one of the preferred embodiments, both a warm air dryer and a heater are used to heat both surface of the coated printing paper.

In the present invention, prior to forming an image by ejecting the ink-jet ink on the coated printing paper, the aqueous processing solution of the present invention is applied on the coated printing paper followed by drying and subsequently an ink-jet ink is ejected to form an image. In order to promote drying the ejected ink and to improve the sharpness of the formed image, it is preferable that the surface temperature of the coated printing paper on which the ink-jet ink is ejected is heated to 40 to 60° C. For this reason, it is preferable that a heater for warming a recording medium is equipped with the apparatus for performing the image formation method of the present invention.

By applying heat to the surface of the coated printing paper on which an image is formed, the aqueous processing solution of the present invention can be dried at the same time of drying the ink-jet ink. About the heating way of the coated printing paper, there may be heated the coated printing paper from a wire side which is opposite to the surface on which an image is formed. There is no restriction in particular about the type of a heater, it is preferable to select a required method from well-known ways, such as an infrared heater, an electrically heated wire, UV lamp, gas, and a hot air dryer. Among them, heating with an electrically heated wire and an infrared heater is more preferable from the point of safety or energy efficiency.

<<Image Forming Method>>

In the image forming method of the present invention, ink-jet printing is performed in such a manner that, employing an ink-jet printer loaded with ink-jet inks, ink droplets are ejected from the ink-jet heads based on the digital signals onto a coated printing paper.

In image formation by ejecting the ink of the present invention, an ink-jet head employed may be either an on-demand type or a continuous type. As an ink ejection system, there may be usable either the electric-mechanical conversion system (e.g., a single-cavity type, a double-cavity type, a bender type, a piston type, a share mode type, or a shared wall type), or an electric-thermal conversion system (e.g., a thermal ink-jet type, or a Bubble Jet type (registered trade name)). Among them, it is preferable to use a piezo type ink-jet recording head which has nozzles of a diameter of 30 μm or less in the image forming method of the present invention.

In the image forming method of the present invention, the type of printing is not particularly limited. Although both single pass type and scanning type may be used, a single pass type is preferably used since it is effective to perform high-speed printing. The single pass type ink-jet recording way is an ink-jet recording method with which ink droplets are struck to all of the pixels to be formed only by one passage of a recording medium passing through the beneath of one ink-jet head unit.

As a devise to attain the single pass type image forming method, it is preferable to use a line head type ink-jet head.

A line head type ink-jet head refers to an ink-jet head having the length more than the width of a printing range. The line head type ink-jet head may have the length of more than the width of a print range with one head, and it may be constructed so that the width of a printing range be exceeded by combining two or more heads as is disclosed in JP-A No. 2007-320278.

An example of an ink-jet recording apparatus which can be used in the image forming method of the present invention will be described by referring to the figures.

FIG. 1 is a schematic drawing showing an example of a single pass type (line-head type) ink-jet recording apparatus which is applicable to the image forming method of the present invention.

In FIG. 1, 11 is a line-head type head unit which is composed of heads 111-114 each ejects an ink of a different color with each other. The nozzle pitch of each head is preferably about 360 dpi. In the present invention, "dpi" indicates a dot number per 2.54 cm.

The coated printing paper P, which is a recording medium, is in the state laminated by rolled form, and is unrolled to an arrow direction for conveyance with transportation mechanism 12. At this time, the coated printing paper P may be heated to a prescribed temperature beforehand by heating member 13, such as an infrared heater, before an aqueous processing solution is applied. Subsequently, a predetermined quantity of the aqueous processing solution is applied on the surface of the coated printing paper P at aqueous processing solution applying member 14. Specifically, the aqueous processing solution is provided from storage tank 15 of the aqueous processing solution to the aqueous processing solution applying member 14 composed of double rolls 16 and 17. Each surface of the double rolls is covered with a porous resin material such as sponge. After providing the aqueous processing solution to auxiliary roll 16 first, the aqueous processing solution is transferred to main roll 17, and a predetermined quantity is applied on the surface of the coated printing paper P. Subsequently, the coated printing paper P on which the aqueous processing solution was given is heated and dried by drying member 18 which is composed of a drying heater installed at the downstream position of the aqueous processing solution applying member 14 in order to decrease the quantity of the water content in the aqueous processing solution to a predetermined range. It is preferable to decrease the water content in an amount of 1.0 weight % to 30 weight % based on the total water content in the provided water processing solution provided on the coated printing paper P.

Subsequently, the coated printing paper P dried to the predetermined amount of the water content in the aqueous processing solution is conveyed to the lower part of head unit 11. Then, image formation is carried out by each color ink ejecting from each heads 111-114 arranged so that the whole width of the coated printing paper P is covered.

When image formation is carried out with heating the coated printing paper P, the coated printing paper P is heated or cooled with temperature control plate 19 arranged at the back side of the coated printing paper P so that the surface temperature of the coated printing paper P will become in the range of 40° C. to 60° C. And then, the coated printing paper P is conveyed to the lower part of head unit 11. Then, image formation is carried out by each color ink ejecting from each heads 111-114 arranged so that the whole width of the coated printing paper P is covered.

When the front surface temperature of the coated printing paper P conveyed at the lower part of the head unit 11 has already reached the temperature in the range of 40° C. to 60° C. by heating with the drying member 18 arranged at the upstream portion of the head unit 11 at this time, it is not necessary to perform heating with the temperature control plate 19. Moreover, when the surface temperature of the coated printing paper P has reached the temperature exceeding 60° C. with heat by the drying heater 18 arranged at the upstream portion of the head unit 11, the temperature is suitably controlled so as to become in the range of 40° C. to 60° C. using suitable cooling means (for example, a cold blast, a coolant, etc.).

Hitherto, the present invention was described by making into an example of the image formation way called "in-line image forming method", in which an applying step of an aqueous processing solution and an image forming step are performed by the same machine. However, in-line image formation way used for the present invention is not restricted to the above-mentioned way. In the present invention, it is also included the method in which two or more machines are connected through a belt conveyor or a roller, and the step of applying an aqueous processing solution, the step of drying a coating solution, and the step of ejecting an ink-jet ink to form an image are continuously performed. In the present invention, it is preferable to carry out image formation with in-line image forming method.

Figure 2:
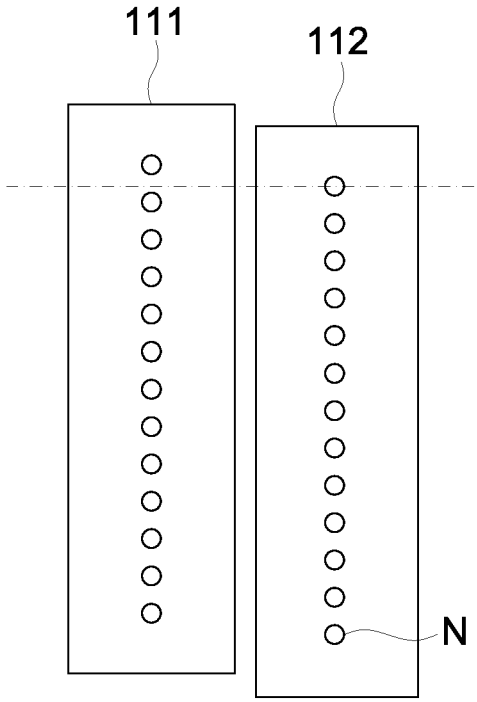
FIG. 2 is a bottom view showing the configuration of nozzles of undersides of head 111 and head 112.

FIG. 2 is a bottom view showing the configuration of the nozzles of underside of the heads 111 and 112.

As shown in FIG. 2, the nozzle N of head 111 and head 112 are located as staggered arrangement shifted every half pitch, respectively. The same staggered arrangement is also done for head 113 and head 114 in FIG. 1. By arranging the configuration of the heads as described-above, a more precise image can be formed.

Figure 3:
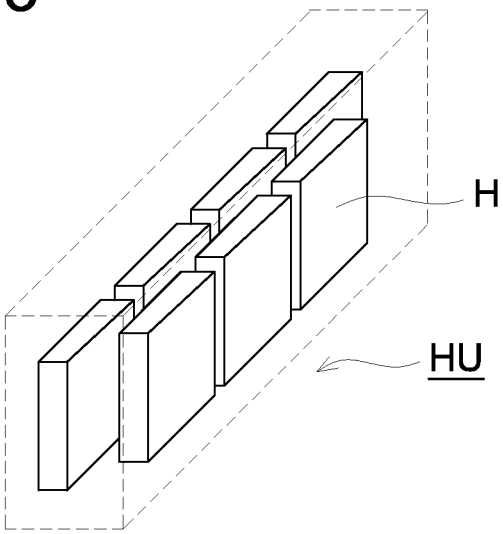
FIG. 3 is a schematic drawing showing an example of a head unit composition.

FIG. 3 is a schematic drawing showing an example of a head unit composition.

When a coated printing paper P of a large print span is used, it is also preferable to use the head unit HU which has arranged two or more heads H in a hound's tooth check arrangement so that the whole width of the coated printing paper P may be covered.

Figure 4:
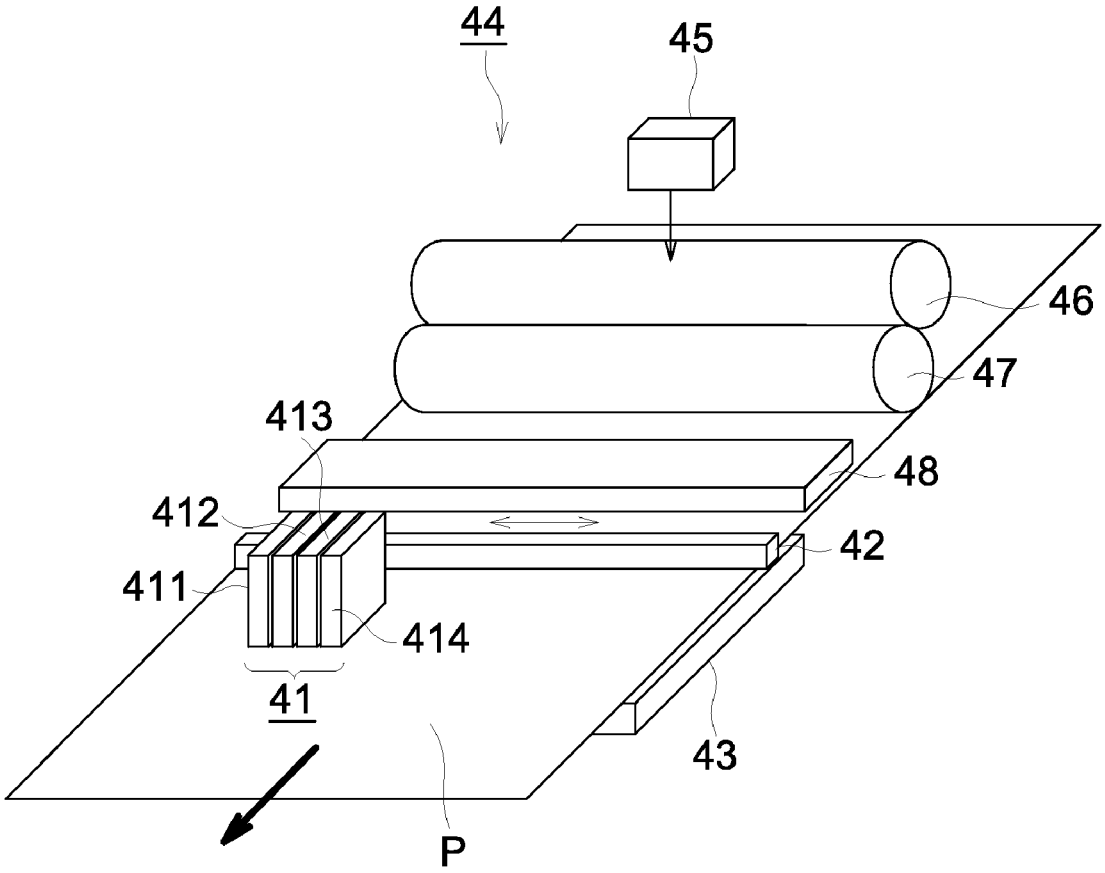
FIG. 4 is a schematic drawing showing an example of a multi pass type (scanning type) ink-jet recording apparatus which is applicable to the image forming method of the present invention.

FIG. 4 is a schematic drawing showing an example of a multi pass type (scanning type) ink-jet recording apparatus which is applicable to the image forming method of the present invention.

In FIG. 4, the aqueous processing solution is provided from the aqueous processing solution applying member 44 on the coated printing paper P unrolled for the conveyance with transportation mechanism (not illustrated) in the same manner as shown in FIG. 1. In FIG. 4, 45 is a storage tank of the aqueous processing solution, 46 is an auxiliary roll and 47 is a main roll. Then, the drying member 48 which is composed of a drying heater is installed at the position from the aqueous processing solution applying member 44 to head unit 41 composed of heads 411-414, and the quantity of the water content in a water processing solution is decreased to fixed extent, and it is dried. Subsequently, with temperature control plate 43 arranged at the back side of the coated printing paper P, the front surface of the coated printing paper P is controlled to become in the range of 40° C. to 60° C., and printing is performed using the head unit 41 of the scanning method held at carriage 42. The scanning is done to the width direction of the coated printing paper P.

EXAMPLE

The present invention is described below with reference to examples, but the present invention is not limited to these. In examples, "part" or "%" is used. Unless particularly mentioned, each respectively represents "weight part" or "weight %".

The following three ink sets ware prepared.

Ink Set A: The inks containing a water soluble resin

Inventive Ink Set

Ink Set B: The inks containing a water soluble resin

Inventive Ink Set

Ink Set C: The inks without containing a water soluble resin

Comparative Ink Set

<<Preparation of Pigment Dispersion>>

(Preparation of Magenta Pigment Dispersion)

Three weight parts of Joncryl 678 (as a pigment dispersing agent, made by BASF Corporation), 1.3 weight parts of dimethylaminoethanol and 80.7 weight parts of ion exchanged water were mixed, and then they were heated with stirring. To the obtained mixture was added 15 weight parts of C. I. Pigment Red 122 and it was premixed. Then, the mixture was dispersed in a sand glider filled with 0.5 mm zirconia beads in an amount of 50% filling ratio to obtain a magenta pigment dispersion having a pigment solid content of 15%.

(Preparation of Cyan Pigment Dispersion)

Three weight parts of Joncryl 678 (as a pigment dispersing agent, made by BASF Corporation), 1.3 weight parts of dimethylaminoethanol and 80.7 weight parts of ion exchanged water were mixed, and then they were heated with stirring. To the mixture was added 15 weight parts of C. I. Pigment Blue 15:3 and it was premixed. Then, the mixture was dispersed in a sand glider filled with 0.5 mm zirconia beads in an amount of 50% filling ratio to obtain a cyan pigment dispersion having a pigment solid content of 15%.

<<Preparation of Ink>>

(Preparation of Ink 1-M)

Among the materials described below, the indicated amounts of the materials except the magenta pigment dispersion were mixed, and they were sufficiently stirred. Then, 33 weight parts of the magenta pigment dispersion were added to the mixture with stirring. After sufficiently stirring, the prepared mixture solution was filtered with a metal filter having a #3,500 mesh. Then, deaeration was carried out using a hollow fiber membrane to produce Ink 1-M. Here, Joncryl JDX 6500 is a water-soluble acrylic resin neutralized with an amine made by BASF Corporation. Joncryl JDX 6500 has an acid value of 74 mgKOH/g, Tg of 65° C. and an average molecular weight of 10,000.

| | |
|---|---|
| Magenta pigment dispersion | 33 weight parts |
| Joncryl JDX 6500 (made by BASF Corporation) | 10 weight parts |
| Olfine E1010 (acetylene glycol surfactant, made by Nissin Chemical Industry Co., Ltd.) | 0.5 weight parts |
| Propylene glycol | 15 weight parts |
| Triethylene glycol monobutyl ether | 5 weight parts |
| Glycerin | 25 weight parts |
| Water | 11.5 weight parts |

(Preparation of Ink 1-C)

Ink 1-C was prepared in the same manner as preparing Ink 1-M except that Magenta pigment dispersion was replaced with the same amount of Cyan pigment dispersion.

(Preparation of Ink 2-M)

Among the materials described below, the indicated amounts of the materials except the magenta pigment dispersion were mixed, and they were sufficiently stirred. Then, 33 weight parts of the magenta pigment dispersion were added to the mixture with stirring. After sufficiently stirring, the prepared mixture solution was filtered with a metal filter having a #3,500 mesh. Then, deaeration was carried out using a hollow fiber membrane to produce Ink 2-M. Here, Joncryl 741 is a styrene-acrylic resin emulsion made by BASF Corporation. Joncryl 741 has an acid value of 54 mgKOH/g, Tg of 15° C. and an average particle size of 100 nm.

| | |
|---|---|
| Magenta pigment dispersion | 33 weight parts |
| Joncryl 741 (made by BASF Corporation) | 6 weight parts |
| Olfine E1010 (acetylene glycol surfactant, made by Nissin Chemical Industry Co., Ltd.) | 0.5 weight parts |
| Propylene glycol | 15 weight parts |
| Triethylene glycol monobutyl ether | 5 weight parts |
| Glycerin | 25 weight parts |
| Water | 15.5 weight parts |

(Preparation of Ink 2-C)

Ink 2-C was prepared in the same manner as preparing Ink 2-M except that Magenta pigment dispersion was replaced with the same amount of Cyan pigment dispersion.

(Preparation of Ink 3-M)

Among the materials described below, the indicated amounts of the materials except the magenta pigment dispersion were mixed, and they were sufficiently stirred. Then, 33 weight parts of the magenta pigment dispersion were added to the mixture with stirring. After sufficiently stirring, the prepared mixture solution was filtered with a metal filter having a #3,500 mesh. Then, deaeration was carried out using a hollow fiber membrane to produce Ink 3-M, which is a comparative ink containing no water soluble resin of the present invention.

| | |
|---|---|
| Magenta pigment dispersion | 33 weight parts |
| Olfine E1010 (acetylene glycol surfactant, made by Nissin Chemical Industry Co., Ltd.) | 0.5 weight parts |
| Propylene glycol | 15 weight parts |
| Triethylene glycol monobutyl ether | 5 weight parts |
| Glycerin | 35 weight parts |
| Water | 11.5 weight parts |

(Preparation of Ink 3-C)

Ink 3-C was prepared in the same manner as preparing Ink 3-M except that Magenta pigment dispersion was replaced with the same amount of Cyan pigment dispersion.

<<Preparation of Ink Set>>

The combination of thus prepared Ink 1-M and Ink 1-C was designated as Ink Set A, the combination of Ink 2-M and Ink 2-C was designated as Ink Set B, and the combination of Ink 3-M and Ink 3-C was designated as Ink Set C.

<<Preparation of Aqueous Processing Solution Capable of Aggregating or Thickening Ink-Jet Ink>>

(Preparation of Aqueous Processing Solution 1)

The following compositions were sequentially added, mixed and fully dissolved. Then the prepared mixture was filtered with a metal filter having a #3,500 mesh. Then, deaeration was carried out using a hollow fiber membrane to produce Aqueous processing solution 1 containing a polyvalent metal salt.

| | |
|---|---|
| Calcium nitrate | 5 weight parts |
| Glycerin | 30 weight parts |
| Diethylene glycol monobutyl ether | 15 weight parts |
| Polyalkylene glycol lauryl ether | 1 weight part |
| Water | 49 weight parts |

(Preparation of Aqueous Processing Solution 2)

The following compositions were sequentially added, mixed and fully dissolved. Then the prepared mixture was filtered with a metal filter having a #3,500 mesh. Then, deaeration was carried out using a hollow fiber membrane to produce Aqueous processing solution 2 containing a polyvalent metal salt.

| | |
|---|---|
| Calcium nitrate | 20 weight parts |
| Glycerin | 25 weight parts |
| Diethylene glycol monobutyl ether | 15 weight parts |
| Polyalkylene glycol lauryl ether | 1 weight part |
| Water | 39 weight parts |

(Preparation of Aqueous Processing Solution 3)

The following compositions were sequentially added, mixed and fully dissolved. Then the prepared mixture was filtered with a metal filter having a #3,500 mesh. Then, deaeration was carried out using a hollow fiber membrane to produce Aqueous processing solution 3 containing an organic acid having a pKa value of not more than 4.5.

| | |
|---|---|
| Maleic acid (pKa 1.75) | 25 weight parts |
| Glycerin | 25 weight parts |
| Diethylene glycol monobutyl ether | 15 weight parts |
| Polyalkylene glycol lauryl ether | 1 weight part |
| Water | 34 weight parts |

(Preparation of Aqueous Processing Solution 4)

The following compositions were sequentially added, mixed and fully dissolved. Then the prepared mixture was filtered with a metal filter having a #3,500 mesh. Then, deaeration was carried out using a hollow fiber membrane to produce Aqueous processing solution 4 containing a cationic resin.

| | |
|---|---|
| HAS-H-1L (quaternary polyamine resin, made by Nitto Boseki Co. Ltd.) | 20 weight parts |
| Glycerin | 5 weight parts |
| Diethylene glycol monobutyl ether | 15 weight parts |
| Polyalkylene glycol lauryl ether | 1 weight part |
| Water | 59 weight parts |

<<Formation of Printing Image>>

[Formation of Image 1]

Image 1 is formed on a coated printing paper with the following printing method A by using Ink set A and Aqueous processing solution 1.

(Printing Method A)

As an ink-jet recording apparatus, an ink-jet recording apparatus of a single pass method (line-head type) disclosed in FIG. 1 was used. As coated printing papers, OK Kanefuji (art paper, made by Oji Paper Co., Ltd.) and Mirror Coat Platinum (cast coat paper, made by Oji Paper Co., Ltd.) were used. While conveying the coated printing paper at a transportation speed of 420 mm/second, aqueous processing solution 1 was uniformly applied to the whole surface of the coated printing paper in an amount of 6.5 ml/m$^2$ using aqueous processing applying member 14 composed of a roller coater. Subsequently, the total amount of water (100 weight %) in the aqueous processing solution applied to the coated printing paper was dried to an extent that the residual water content after drying became to be 1.0 weight % using the drying member 18 provided with a drying heater containing a heating element and a blower fan therein. Subsequently, the coated printing paper which has been decreased the amount of the water content of the aqueous processing solution 1 to 1 weight % was conveyed to the head unit 11, and the ink set A was ejected from the head unit 11.

In addition, each of the water contents of the aqueous processing solution 1 before and after the drying was measured using an infrared water content meter, and the water content decreasing ratio was determined based on each measurement value.

Each head of 111-114 which constitutes head unit 11 has been arranged so that two heads of 360 dpi were arranged to become the configuration with a staggered nozzle arrangement as shown in FIG. 2 and to form a line head so that the full width of the coated printing paper was covered with a plurality of heads as shown FIG. 3. Ink 1-M which constitutes the ink set A was ejected from the head 112, while Ink 1-C which constitutes the ink set A was ejected from the head 111 to achieve the print resolution of 720 dpi×720 dpi respectively, with an ejected ink droplet having a volume of 16 pl. Each color patch having a printing ratio of 0 to 100% was prepared, and this image was called Image 1. In addition, at the time of printing, the temperature was controlled by the temperature control plate 19 installed at the back side of the coated printing paper conveyed so that the printing surface temperature of the coated printing paper became 45° C. The printing surface temperature of the coated printing paper was measured with a non-contact type infrared thermometer.

[Formation of Images 2-4]

Images 2-4 each were respectively formed in the same manner as forming Image 1 except that the aqueous processing solutions 2-4 each were used instead of the aqueous solution 1.

[Formation of Images 5-9]

Images 5-9 each were respectively formed in the same manner as forming Image 2 except that the drying condition (drying temperature) of the drying member 18 arranged in the position between the aqueous processing solution applying member 14 and the head unit 11 was changed so as to achieve the residual water content (weight %) as listed in Table 1.

[Formation of Images 10-15]

Images 10-15 each were respectively formed in the same manner as forming Image 2 except that the printing surface temperature of the coated printing paper during the application of Ink set A by the head unit 11 was changed as the temperature listed in Table 1.

[Formation of Images 16 and 17]

Images 16 and 17 each were respectively formed in the same manner as forming Image 2 except that the amount of the aqueous processing solution 2 applied by the aqueous processing solution applying member 14 was changed to 3.0 ml/m$^2$ and 15.2 ml/m$^2$, respectively.

[Formation of Image 18]

Image 18 was formed in the same manner as forming Image 2 except that Printing method B was used instead of Printing method A.

(Printing Method B)

As an ink-jet recording apparatus, an ink-jet recording apparatus of a multi pass method (scanning type) disclosed in FIG. 4 was used. As coated printing papers, OK Kanefuji (art paper, made by Oji Paper Co., Ltd.) and Mirror Coat Platinum (cast coat paper, made by Oji Paper Co., Ltd.) were used. While conveying the coated printing paper at a transportation speed of 420 mm/second, aqueous processing solution 2 was uniformly applied to the whole surface of the coated printing paper in an amount of 6.5 ml/m$^2$ using aqueous processing applying member 44 composed of a roller coater.

Subsequently, the total amount of water (100 weight %) in the aqueous processing solution applied to the coated printing paper was dried to an extent that the residual water content after drying became to be 1.0 weight % using the drying member 48 provided with a drying heater containing a heating element and a blower fan therein. Subsequently, the coated printing paper which has been decreased the amount of the water content of the aqueous processing solution 2 to 1 weight % was conveyed to the head unit 41, and the ink set A was ejected from the head unit 41.

In addition, each of the water contents of the aqueous processing solution 2 before and after the drying was measured using an infrared water content meter, and the water content decreasing ratio was determined based on each measurement value.

Each head of 411-414 which constitutes head unit 41 is composed of two heads of 360 dpi and it performs printing by moving both lateral directions of the paper. Ink 1-M which constitutes the ink set A was ejected from head 413, while Ink 1-C which constitutes the ink set A was ejected from head 414 to achieve the print resolution of 720 dpi×720 dpi respectively, with an ejected ink droplet having a volume of 16 pl. Each color patch having a printing ratio of 0 to 100% was prepared, and this image was called Image 18. In addition, at the time of printing, the temperature was controlled by the temperature control plate 43 installed at the back side of the coated printing paper conveyed so that the printing surface temperature of the coated printing paper became 45° C. The printing surface temperature of the coated printing paper was measured with a non-contact type infrared thermometer.

[Formation of Images 19 and 20]

Images 19 and 20 each were respectively formed in the same manner as forming Image 18 except that the aqueous processing solutions 3 and 4 each were used instead of the aqueous processing solution 2.

[Formation of Image 21]

Image 21 was formed in the same manner as forming Image 18 except that the printing surface temperature of the coated printing paper during the application of Ink set A by the head unit 41 was changed from 45° C. to 55° C.

[Formation of Images 22 and 23]

Images 22 and 23 each were respectively formed in the same manner as forming Image 18 except that the amount of the aqueous processing solution 2 applied by the aqueous processing solution applying member 44 was changed to 3.0 ml/m$^2$ and 15.2 ml/m$^2$, respectively.

[Formation of Image 32]

Image 32 was formed in the same manner as forming Image 2 produced with Printing method A except that the aqueous processing solution 2 was not applied. This printing method used for forming Image 32 was called as Printing method C.

[Formation of Image 33]

Image 33 was formed in the same manner as forming Image 2 produced with Printing method A except that the drying member 18 arranged between the aqueous processing applying member 14 and the head unit 11 was not used. This printing method used for forming Image 33 was called as Printing method D.

[Formation of Image 34]

Image 34 was formed in the same manner as forming Image 2 produced with Printing method A except that the aqueous processing applying member 14 and the drying member 18 were not used, and the aqueous processing solution 2 was applied by using the heads 113 and 114 of the head unit 11, immediately thereafter, Ink 1-M which constitutes the ink set A was ejected from the head 112, while Ink 1-C which constitutes the ink set A was ejected from the head 111 to produce Image 34. This printing method used for forming Image 34 was called as Printing method E.

[Formation of Images 24-31 and 35-38]

Images 24-31 and 35-38 each were respectively formed under the conditions as indicated in Table 1.

TABLE 1

| Image No. | Ink set No. | Aqueous processing solution No. | Applied amount (ml/m$^2$) | Printing method | Drying process (Yes, None) | *1 (weight %) | *2 (° C.) | Remarks |
|---|---|---|---|---|---|---|---|---|
| 1 | A | 1 | 6.5 | A | Yes | 1.0 | 45 | Inv. |
| 2 | A | 2 | 6.5 | A | Yes | 1.0 | 45 | Inv. |
| 3 | A | 3 | 6.5 | A | Yes | 1.0 | 45 | Inv. |
| 4 | A | 4 | 6.5 | A | Yes | 1.0 | 45 | Inv. |
| 5 | A | 2 | 6.5 | A | Yes | 40 | 45 | Inv. |
| 6 | A | 2 | 6.5 | A | Yes | 30 | 45 | Inv. |
| 7 | A | 2 | 6.5 | A | Yes | 15 | 45 | Inv. |
| 8 | A | 2 | 6.5 | A | Yes | 10 | 45 | Inv. |
| 9 | A | 2 | 6.5 | A | Yes | 5.0 | 45 | Inv. |
| 10 | A | 2 | 6.5 | A | Yes | 1.0 | 30 | Comp. |
| 11 | A | 2 | 6.5 | A | Yes | 1.0 | 35 | Comp. |
| 12 | A | 2 | 6.5 | A | Yes | 1.0 | 40 | Inv. |
| 13 | A | 2 | 6.5 | A | Yes | 1.0 | 55 | Inv. |
| 14 | A | 2 | 6.5 | A | Yes | 1.0 | 60 | Inv. |
| 15 | A | 2 | 6.5 | A | Yes | 1.0 | 65 | Comp. |
| 16 | A | 2 | 3.0 | A | Yes | 1.0 | 45 | Inv. |
| 17 | A | 2 | 15.2 | A | Yes | 1.0 | 45 | Inv. |
| 18 | A | 2 | 6.5 | B | Yes | 1.0 | 45 | Inv. |
| 19 | A | 3 | 6.5 | B | Yes | 1.0 | 45 | Inv. |
| 20 | A | 4 | 6.5 | B | Yes | 1.0 | 45 | Inv. |
| 21 | A | 2 | 6.5 | B | Yes | 1.0 | 55 | Inv. |
| 22 | A | 2 | 3.0 | B | Yes | 1.0 | 45 | Inv. |
| 23 | A | 2 | 15.2 | B | Yes | 1.0 | 45 | Inv. |
| 24 | B | 2 | 6.5 | A | Yes | 1.0 | 45 | Inv. |
| 25 | B | 3 | 6.5 | A | Yes | 1.0 | 45 | Inv. |
| 26 | B | 4 | 6.5 | A | Yes | 1.0 | 45 | Inv. |
| 27 | B | 2 | 6.5 | A | Yes | 40 | 45 | Inv. |
| 28 | B | 2 | 6.5 | A | Yes | 30 | 45 | Inv. |
| 29 | B | 2 | 6.5 | A | Yes | 15 | 45 | Inv. |
| 30 | B | 2 | 6.5 | A | Yes | 10 | 45 | Inv. |
| 31 | B | 2 | 6.5 | A | Yes | 5.0 | 45 | Inv. |
| 32 | A | — | — | C | None | — | 45 | Comp. |
| 33 | A | 2 | 6.5 | D | None | 85 | 45 | Comp. |
| 34 | A | 2 | 6.5 | E | None | 95 | 45 | Comp. |
| 35 | C | 1 | 6.5 | A | Yes | 1.0 | 45 | Comp. |
| 36 | C | 2 | 6.5 | A | Yes | 1.0 | 45 | Comp. |
| 37 | C | 3 | 6.5 | A | Yes | 1.0 | 45 | Comp. |
| 38 | C | 4 | 6.5 | A | Yes | 1.0 | 45 | Comp. |

Inv.: Inventive example,
Comp.: Comparative example
*1: residual water content (weight %) of the aqueous processing solution after drying process
*2: surface temperature (° C.) of the coated printing paper at the time of applying the ink <<Evaluation of Formed Images>>

[Evaluation of Sharpness]

(Sharpness at a High Printing Ratio)

The portion of a patch image having a printing ratio of 60 to 100% among the patch image having a printing ratio of 0 to 100% was observed with microscope and visually observed. The sharpness at a high printing ratio was evaluated in accordance with the following criteria.

A: The shape of dot remains clearly without deterioration in all of the printing ratios observed.

B: Partial jointing of dots is observed, and there is also observed a strong uneven distribution of an ink depending on the condition of error dispersion.

C: In a high density portion, there is observed a place in which a hollow portion is completely filled. In a medium tone portion, jointing of dots is observed, as a result, deterioration of sharpness and coarse granularity are recognized.

(Sharpness at a Low Printing Ratio)

The portion of a patch image having a printing ratio of 10 to 50% among the patch image having a printing ratio of 0 to 100% was observed with microscope and visually observed. The sharpness at a low printing ratio was evaluated in accordance with the following criteria.

A: All of the shapes of dots which form the solid image of the printing ratio of 10 to 50% are perfectly circular when observed with microscope.

B: Partial bleeding of dots can be recognized, and the image exhibits slightly deteriorated sharpness.

C: Bleeding of dots and swelling of fine lines can be recognized, and the image exhibits deteriorated sharpness.

[Evaluation of Mottling Resistance]

About the image samples prepared as described above, visual observation of appearance of mottling (phenomenon of gathering of ink droplets) was carried out. The mottling resistance was evaluated in accordance with the following criteria.

A: In a patch image of printing ratio of 0-100%, appearance of mottling and jointing of dots are not observed.

B: In a solid image of a high printing ratio, appearance of mottling is not observed, however, in a solid image of a middle density region, slight appearance of mottling is observed.

C: Even in a solid image of a high printing ratio, appearance of mottling is distinctly observed.

[Evaluation of Bleeding Resistance]

A cyan solid image having a printing ratio of 100% was printed on a magenta solid image having a printing ratio of 100%. Visual observation of appearance of bleeding (smearing of the image) was carried out to the produced image. The bleeding resistance was evaluated in accordance with the following criteria.

A: Bleeding of less than 0.02 mm is observed in a cyan image.

B: Bleeding of from 0.02 mm to less than 0.05 mm is observed in a cyan image.

C: Bleeding of 0.05 mm or more is observed in a cyan image.

[Evaluation of Glossiness]

Visual observation of the state of the glossiness of the patch image printed to OK Kanefuji and Mirror Coat Platinum was carried out, and the glossiness was evaluated in accordance with the following criteria.

A: In a printed image on OK Kanefuji, there is observed no difference of glossiness between the non printed portion and the printed portion. While, in a printed image on Miller Coat Platinum, although there is slightly observed decrease of glossiness in the printed portion, the glossiness is good.

B: There is observed slight difference of glossiness between the non printed portion and the printed portion in printed images on both OK Kanefuji and Mirror Coat Platinum. However, this difference can be acceptable for practical use.

C: There is observed a rough structure in the printed portion of printed images on both OK Kanefuji and Mirror Coat Platinum. The printed image exhibits deteriorated glossiness.

[Evaluation of Cockling Resistance]

Visual observation of appearance of waving or wrinkles was carried out against coated printing papers (OK Kanefuji and Mirror coat platinum) on which the above-described image was formed. The cockling resistance was evaluated in accordance with the following criteria.

A: There is slightly observed cockling on one of the coated printing papers when the print is wet, however, the cockling disappears after drying the print.

B: There is slightly observed cockling on one of the coated printing papers even after drying the print. However, this cockling can be acceptable for practical use.

C: There is observed strong cockling, and the bottom of the ink-jet head is sometimes touched by the cockling when the ink is ejected.

The obtained evaluation results are shown in Table 2.

TABLE 2

| Image No. | Sharpness: Portion of high printing ratio | Sharpness: Portion of low printing ratio | Mottling resistance | Bleeding resistance | Glossiness | Cockling resistance | Remarks |
|---|---|---|---|---|---|---|---|
| 1 | B | B | A | B | A | A | Inv. |
| 2 | A | A | A | A | A | A | Inv. |
| 3 | A | A | A | A | A | A | Inv. |
| 4 | A | A | A | A | A | A | Inv. |
| 5 | B | B | A | A | A | B | Inv. |
| 6 | A | B | A | A | A | B | Inv. |
| 7 | A | A | A | A | A | A | Inv. |
| 8 | A | A | A | A | A | A | Inv. |
| 9 | A | A | A | A | A | A | Inv. |
| 10 | B | B | C | C | B | A | Comp. |
| 11 | B | B | B | C | B | A | Comp. |
| 12 | B | B | A | B | A | A | Inv. |
| 13 | A | A | A | A | A | A | Inv. |
| 14 | B | B | A | A | B | B | Inv. |
| 15 | B | B | A | A | C | C | Comp. |
| 16 | B | B | A | B | A | A | Inv. |
| 17 | A | A | A | A | A | B | Inv. |
| 18 | A | A | A | A | A | A | Inv. |
| 19 | A | A | A | A | A | A | Inv. |
| 20 | A | A | A | A | A | A | Inv. |
| 21 | A | A | A | A | A | A | Inv. |
| 22 | B | B | A | B | A | A | Inv. |
| 23 | B | B | A | A | A | B | Inv. |
| 24 | A | A | A | B | A | A | Inv. |
| 25 | A | A | A | B | A | A | Inv. |
| 26 | A | A | A | B | A | A | Inv. |
| 27 | B | B | A | A | A | B | Inv. |
| 28 | A | B | A | A | A | B | Inv. |
| 29 | A | A | A | A | A | A | Inv. |
| 30 | A | A | A | A | A | A | Inv. |
| 31 | A | A | A | A | A | A | Inv. |
| 32 | C | C | C | C | A | A | Comp. |
| 33 | C | C | B | B | A | B | Comp. |
| 34 | C | C | B | B | A | B | Comp. |
| 35 | C | C | B | C | C | A | Comp. |
| 36 | C | C | B | C | C | A | Comp. |

TABLE 2-continued

| Image No. | Sharpness: Portion of high printing ratio | Sharpness: Portion of low printing ratio | Mottling resistance | Bleeding resistance | Glossiness | Cockling resistance | Remarks |
|---|---|---|---|---|---|---|---|
| 37 | C | C | B | C | C | A | Comp. |
| 38 | C | C | B | C | C | B | Comp. |

Inv.: Inventive example,
Comp.: Comparative example

As is clearly shown by the results listed in Table 2, the image formed in accordance with the image forming method of the present invention is excellent in sharpness at a portion of both low printing ratio and high printing ratio, and excellent in the mottling resistance, the bleeding resistance, the glossiness, and the cackling resistance as compared to a comparative example.

What is claimed is:

1. A method for forming an image with an ink-jet recoding method which forms the image on a coated printing paper by employing an ink comprising water in an amount of 20 to 90 weight % based on the total weight of the ink, a pigment and a resin, the method comprising the sequential steps of:

applying an aqueous processing solution on the coated printing paper;

drying the aqueous processing solution applied on the coated printing paper; and ejecting droplets of the ink on the coated printing paper, wherein the aqueous processing solution is capable of aggregating the ink or increasing a viscosity of the ink, and the coated printing paper is heated from 40 to 60° C. during the step of ejecting the droplets of the ink.

2. The method for forming an image with an ink-jet recoding method claim 1, wherein a content of water in the aqueous processing solution after applied on the coated printing paper is reduced in the range of 0.1 weight % to 30 weight % based on a content of water contained in the aqueous processing solution by the drying step, and then, the ejection step of the ink is carried out.

3. The method for forming an image with an ink-jet recoding method of claim 1, wherein the aqueous processing solution contains at least one of the group consisting of a polyvalent metal salt, an acid and a cationic resin.

4. The method for forming an image with an ink-jet recoding method of claim 1, wherein the aqueous processing solution contains a polyvalent metal salt.

5. The method for forming an image with an ink-jet recoding method of claim 3, wherein the polyvalent metal salt contains at least a cation selected from the group consisting of a calcium ion, a copper ion, a nickel ion, a magnesium ion, a barium ion, an aluminium ion, an iron ion, a chromium ion, a yttrium ion and a zirconium ion.

6. The method for forming an image with an ink-jet recoding method of claim 3, wherein the polyvalent metal salt contains at least an anion selected from the group consisting of a carbonate ion, a sulfate ion, a nitrate ion, a chloride ion, an organic acid ion, a borate ion and a phosphate anion.

7. The method for forming an image with an ink-jet recoding method of claim 1, wherein the aqueous processing solution contains an organic acid having a pKa value of 4.5 or less.

8. The method for forming an image with an ink-jet recoding method of claim 3, wherein the acid is at least one selected from the group consisting of hydrochloric acid, nitric acid, sulfuric acid, phosphoric acid, carbonic acid, citric acid, isocitric acid, oxalic acid, maleic acid, fumaric acid, malonic acid, succinic acid, glutaric acid, adipic acid, phthalic acid, isophthalic acid, terephthalic acid, citric acid, 2-pyrrolidone-5-carboxylic acid, benzoic acid, a benzoic acid derivative, salicylic acid, ascorbic acid, malic acid, benzenesulfonic acid, a benzenesulfonic acid derivative, pyruvic acid and oxalacetic acid.

9. The method for forming an image with an ink-jet recoding method of claim 1, wherein the resin has an acid group which is neutralized with an amine.

10. The method for forming an image with an ink-jet recoding method of claim 9, wherein the resin having an acid group which is neutralized with an amine has a weight average molecular weight of 3,000 to 30,000.

11. The method for forming an image with an ink-jet recoding method of claim 9, wherein the resin having an acid group which is neutralized with an amine exhibits an acid value of 60 to 300 mgKOH/g.

12. The method for forming an image with an ink-jet recoding method of claim 1, wherein the resin contained in the ink is a water soluble resin.

13. The method for forming an image with an ink-jet recoding method of claim 1, wherein the water soluble resin has a weight average molecular weight of 5,000 or more.

14. The method for forming an image with an ink-jet recoding method of claim 3, wherein the cationic resin is at least one selected from the group consisting of polyallylamine, polyamine, cation modified acrylate resin, cation modified methacrylic resin, cation modified vinyl resin, cationic polyurethane resin and a copolymer thereof.

15. The method for forming an image with an ink-jet recoding method of claim 1, wherein the ink contains an organic solvent in an amount of 20 to 60 weight % based on a total weight of the ink.

16. The method for forming an image with an ink-jet recoding method of claim 1, wherein the applying step of the aqueous processing solution is conducted two times or more, then the drying step of the aqueous processing solution is carried out.

17. The method for forming an image with an ink-jet recoding method of claim 1, wherein the applying step of the aqueous processing solution is conducted with a method selected from the group consisting of a roller coating method, an ink-jet method, a curtain coating method and a spray coating method.

18. The method for forming an image with an ink-jet recoding method of claim 1, wherein the drying step of the aqueous processing solution is conducted with a heater, a warm air dryer, or a hating roller.

19. The method for forming an image with an ink-jet recoding method of claim 1, wherein the drying step of the aqueous processing solution is conducted with a heater and a warm air dryer.

* * * * *